United States Patent [19]

Watabe

[11] Patent Number: 4,516,407

[45] Date of Patent: May 14, 1985

[54] REFRIGERATING APPARATUS

[75] Inventor: Shin Watabe, Nagoya, Japan

[73] Assignee: Mitsubishi Jukogyo Kabushiki Kaisha, Japan

[21] Appl. No.: 498,962

[22] Filed: May 27, 1983

[30] Foreign Application Priority Data

Jun. 3, 1982 [JP] Japan ..... 57-95248

[51] Int. Cl.[3] ..... F25B 27/02

[52] U.S. Cl. ..... 62/238.6; 62/506

[58] Field of Search ..... 62/181, 183, 238.6, 62/506, 509

[56] References Cited

U.S. PATENT DOCUMENTS

| | | | |
|---|---|---|---|
| 2,627,730 | 2/1953 | Zearfoss, Jr. | 62/509 X |
| 3,481,152 | 12/1969 | Seeley | 62/506 X |
| 4,314,452 | 2/1982 | Waters | 62/238.6 X |
| 4,324,106 | 4/1982 | Ross et al. | 62/509 X |
| 4,423,602 | 1/1984 | Venable | 62/238.6 |

*Primary Examiner*—Lloyd L. King
*Attorney, Agent, or Firm*—McGlew and Tuttle

[57] ABSTRACT

An improved refrigerating apparatus including a compressor, air cooling type condensers, an expansion valve and an evaporator which are connected in series one after another in the refrigerating system, is disclosed, wherein the improvement consists in that the air cooling type condensers comprise an upstream air cooling type condenser and a downstream air cooling type condenser which are separately arranged in the refrigerating system and a water cooling type which condenser is disposed between both the upstream and downstream air cooling type condensers. Owing to the arrangement of the refrigerating apparatus in accordance with the invention, reduced space required for mounting the refrigerating apparatus, and decreased volume of refrigerant required for operating the refrigerating apparatus are assured.

7 Claims, 3 Drawing Figures

REFRIGERATING APPARATUS

FIELD AND BACKGROUND OF THE INVENTION

The present invention relates to a refrigerating apparatus.

To facilitate understanding of the present invention it will be helpful that a conventional refrigerating apparatus including an air cooling type condenser adapted to cooperate with a water cooling type condenser will be briefly described below with reference to FIG. 1 which is a system diagram schematically illustrating the conventional refrigerating apparatus.

First, description will be made as to the case when the refrigerating apparatus is operated with the aid of air cooling. Refrigerant gas discharged from a compressor 1 at high temperature and pressure enters an air cooling type condensor 2 with a blower 6 disposed in the proximity thereof for the purpose of cooling so that heat included in refrigerant gas is emitted from the air cooling type condenser 2 whereby it is liquidized therein. Refrigerant is then delivered to a water cooling type condenser 3. In this case, however, no cooling water flows through the water cooling type condenser 3 and therefore the latter serves merely as a liquid receiver or storage, because no heat radiation is effected therefrom. After leaving the water cooling type condenser 3, refrigerant reaches an expansion valve 4 in which it is subjected to pressure reduction and then it enters an evaporator 5 in which it is evaporated by extracting heat from the surroundings. After completion of evaporation refrigerant comes back to the compressure 1 and thereby a single cycle of refrigeration is finished.

Next, description will be made as to the case when the refrigerating apparatus is operated with the aid of water cooling. Refrigerant gas discharged from the compressor 1 at high temperature and pressure enters the air cooling type condenser 2 with the blower 6 disposed in the proximity thereof for the purpose of cooling. When the blower 6 is rotated, a part of heat included in refrigerant is emitted into the environmental air by way of forcible convection, whereas when the blower 6 is not rotated, the air cooling type condenser 2 is heated up to a considerably high temperature but a part of heat included in refrigerant is also emitted into the environmental air by way of natural convection. Thus, a part of heat is emitted from the air cooling type condenser 2 in that way and thereafter refrigerant is delivered to the water cooling type condenser 3 through which cooling water 7 flows circulatively at all time. Heat removal is effected further from the water cooling type condenser 3 with the aid of the cooling water 7 until refrigerant gas is liquidified therein. Then, refrigerant liquid reaches the expansion valve 4 in which it is subjected to pressure reduction. Next, it enters the evaporator 5 in which it is evaporated by extracting heat from the surroundings. After completion of evaporation it comes back to the compressor 1 and thereby a single cycle of refrigeration is finished.

In the above-described conventional refrigerating system it is required that the water cooling type condenser 3 serves not only as a liquid receiver during operation of the refrigerating apparatus with the aid of air cooling but also as an ordinary water cooling type condenser during operation of the same with the aid of water cooling. Accordingly, the water cooling type condenser 3 is required to hold a sufficient volume of refrigerant therein, resulting in considerably increased space required for mounting it. Further, there is necessity for storing a surplus volume of refrigerant in the water cooling type condenser in order to assure that the latter serves as a liquid storage satisfactorily. As a result an ample volume of refrigerant is required for operating the conventional refrigerating apparatus.

SUMMARY OF THE INVENTION

Thus, the present invention has been proposed with the foregoing background in mind. It is an object of the present invention to provide an improved refrigerating apparatus which requires reduced space for mounting it. To accomplish the above object there is proposed in accordance with the present invention a refrigerating apparatus of the type including a compressor, air cooling type condensers, an expansion valve and an evaporator which are connected in series one after another in the refrigerating system, wherein the air cooling type condensers comprise an upstream air cooling type condenser and a downstream air cooling type condenser which are separately arranged in the refrigerating system and a water cooling type condenser is disposed between both the upstream and downstream air cooling type condensers.

BRIEF DESCRIPTION OF THE DRAWINGS

The accompanying drawings will be briefly described below.

DESCRIPTION OF THE PREFERRED EMBODIMENTS

Now, the present invention will be described in greater detail hereunder with reference to FIGS. 2 and 3.

Figure 1:
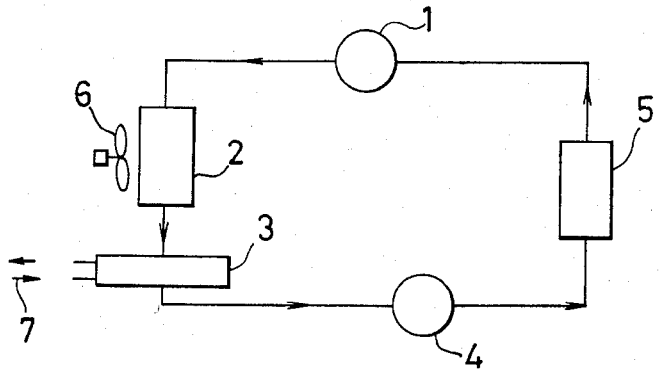
PRIOR ART FIG.1
FIG. 1 is a system diagram which schematically illustrates a conventional refrigerating apparatus including an air cooling type condenser adapted to cooperate with a water cooling type condenser.
Figure 2:
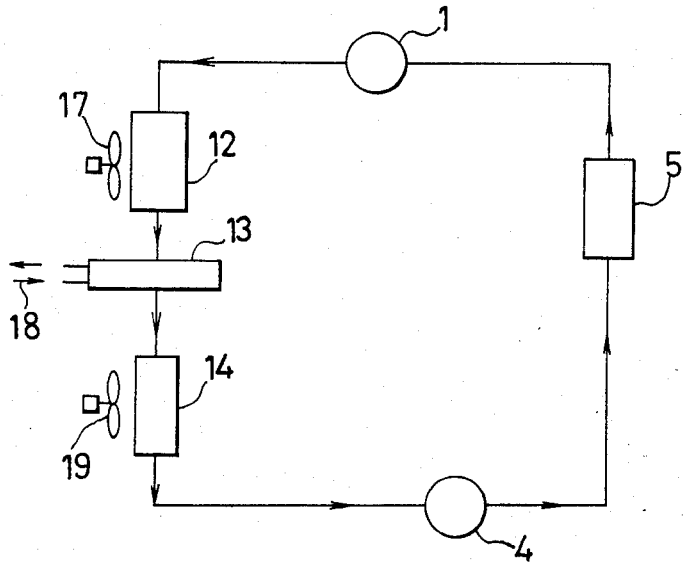
FIG. 2 is a system diagram which schematically illustrates a refrigerating apparatus in accordance with the first embodiment of the invention.

First, description will be made as to a refrigerating apparatus in accordance with the first embodiment of the invention which is schematically illustrated in FIG. 2. In this connection it should be noted that the same or similar apparatus components as those in FIG. 1 are identified with the same reference numerals. In the drawing reference numeral 12 designates a first air cooling type condenser, reference numeral 13 designates a water cooling type condenser, reference numeral 14 designates a second air cooling type condenser, reference numeral 17 designates a blower, reference numeral 18 designates cooling water and reference numeral 19 designates another blower.

Now, operation of the refrigerating apparatus in accordance with the first embodiment of the invention will be first described in case when it is operated with air for air cooling. Refrigerant gas enters the first air cooling type condenser 12 at high temperature and pressure after it is discharged from a compressor 1. Since the blower 17 is rotating for the first air cooling type condenser 12, refrigerant gas is caused to cool in the latter while it is emitting a part of the energy included therein. A part of the cooled refrigerant gas is liquidized and thereafter refrigerant flows into the water cooling type condenser 13. It should be noted that in case of operation of the refrigerating apparatus with the aid of air cooling no cooling water flows in the water cooling type condenser 13 and therefore the latter has no capability of condensing refrigerant gas. For this reason it serves merely as a piping. Refrigerant enters the second air cooling type condenser 14 after it leaves the water cooling type condenser 13. Since the blower 19 is rotating for the second air cooling type condenser 14, refrigerant emits heat further until condensation is completed therein. Next, liquid refrigerant reaches an expansion valve 4 in which it is in turn subjected to pressure reduction. It is then delivered to an evaporator 5 in which it is evaporated by extracting heat from the surroundings. After completion of evaporation refrigerant comes back to the compressor 1 and thereby a single cycle of refrigeration is finished.

Next, operation of the refrigerating apparatus will be described as to the case when it is operated with the aid of water cooling. Refrigerant gas enters the first air cooling type condenser 12 at high temperature and pressure after it is discharged from the compressor 1. When the blower 17 is rotated, a part of heat is emitted from refrigerant gas by way of forcible convection around the first air cooling type condenser 12, whereas when the blower is not rotated, the first air cooling type condenser 12 is heated up to a considerably high temperature, a part the of heat is emitted into the environmental air by way of natural convection. After a part of the heat included in refrigerant is emitted in the first air cooling type condenser 12, it flows into the water cooling type condenser 13 through which cooling water 18 flows circulatively at all time. Owing to the fact that cooling water flows therethrough for the purpose of cooling a substantial part of refrigerant gas is liquidized and thereafter liquid refrigerant flows into the second air cooling type condenser 14. If the blower 19 is rotated residual refrigerant gas is liquidized by way of forcible convection, whereas when the blower is not rotated it is liquidized by way of natural convection which facilitates heat radiation from the second air cooling type condenser 14. Thus, liquidization of refrigerant is completed. If refrigerant gas is already liquidized when it leaves the water cooling type condenser 13, the second air cooling type condenser 14 serves merely as a piping.

After completion of liquidization of refrigerant in the second air cooling type condenser 14 in that way refrigerant liquid is delivered to the expansion valve 4 in which it is subjected to pressure reduction and then it flows into the evaporator 5 in which it is evaporated by extracting heat from the surroundings. After completion of evaporation refrigerant comes back to the compressor 1 and thereby a single cycle of refrigeration is finished.

As will be readily apparent from the above description, the water cooling type condenser 13 serves merely as a piping in case of operation of the refrigerating apparatus with the aid of air cooling, whereas the second air cooling type condenser 14 serves merely as a refrigerant liquid receiver in case of operation of the apparatus with the aid of water cooling. Thus, it results that the water cooling type condenser 13 requires a very small volume of inside space through which refrigerant flows and therefore there is necessity for a small area of space where the water cooling type condenser 13 is to be mounted and that no extra volume of refrigerant is required because the water cooling type condenser 13 does not serve as a refrigerant liquid storage and thus it becomes possible to reduce a required volume of refrigerant.

In the above-described embodiment of the invention both the first air cooling type condenser 12 and the second air cooling type condensor 14 are arranged separately one from another. Alternatively, they may be made integral with one another as a single air cooling condenser in which the water cooling type condenser 13 is disposed at the position located midway of the refrigerant passages. Further, both the blowers 17 and 19 may be replaced with a single one or more than two blowers may be arranged for the same purpose.

Figure 3:
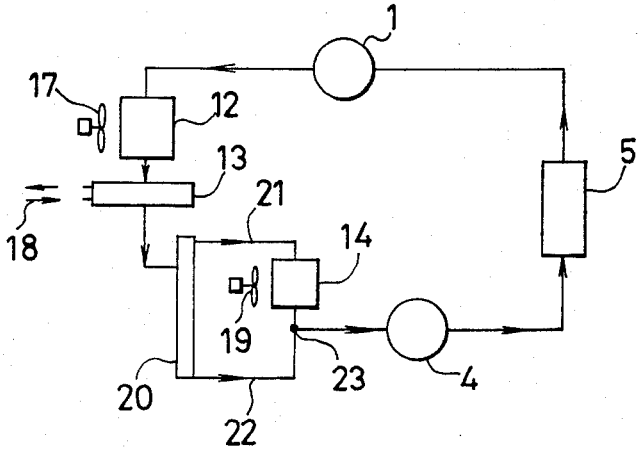
FIG. 3 is a system diagram which schematically illustrates a refrigerating apparatus in accordance with the second embodiment of the invention.

Next, description will be made as to a refrigerating apparatus in accordance with the second embodiment of the invention which is schematically illustrated in FIG. 3. The same apparatus components as those in FIG. 2 are identified with the same reference numerals but their repeated description will not be required. In the drawing reference numeral 21 designates an upper communication pipe, reference numeral 22 designates a lower communication pipe and reference numeral 23 designates a junction therebetween.

In case of the illustrated refrigerating apparatus operation of the latter is the same as in case of the foregoing first embodiment until refrigerant leaves the water cooling type condenser 13 for both the types of air cooling and water cooling.

When the apparatus is operated with the aid of air cooling, a large part of refrigerant flowing into a gas-liquid separator 20 after leaving the water cooling type condenser 13 is gaseous while a small part of the same is in the form of liquid.

Refrigerant gas flows into the second gas cooling type condenser 14 via the upper communication pipe 21. Since a large volume of refrigerant flows through the second air cooling type condenser 14 in this case, a high level of refrigerant pressure loss is caused whereby the liquid surface in the gas-liquid separator 20 assumes a considerably lower position. Thus, when the lowermost end position of the gas-liquid separator 20 is lowered sufficiently, it results that all refrigerant gas flows into the second air cooling type condenser 14. While the blower 19 is rotating, heat included in refrigerant gas is emitted into the environmental air until it is liquidized. Then, liquidized refrigerant reaches the junction 23 in which it is united with another liquidized refrigerant coming from the gas-liquid separator 20 via the lower communication pipe 22 and the combined refrigerant is delivered to the expansion valve 4 in which it is subjected to pressure reduction. Next, it enters the evaporator 5 in which it is evaporated by extracting heat from the surroundings. After completion of evaporation refrigerant comes back to the compressor 1 and thereby a single cycle of refrigeration is finished.

Next, when the apparatus is operated with the aid of water cooling, a large part of refrigerant flowing into the gas-liquid separator 20 after leaving the water cooling type condenser 13 is in the form of liquid while a small part of the same is gaseous. Refrigerant liquid is separated from refrigerant gas in the gas-liquid separator 20 and it is then delivered to the junction 23 via the lower communication pipe 22, whereas refrigerant gas flows into the second air cooling type condenser 14 via the upper communication pipe 21 in which it is liquidized in the same manner as in the foregoing first embodiment and after completion of liquidization refrigerant liquid reaches the junction 23.

If liquidization is completed until refrigerant leaves the water cooling type condensor 13, no refrigerant flows into the second air cooling type condenser 14 and thus the gas-liquid separator 20 serves merely as a liquid receiver.

Refrigerant liquid united at the junction 23 reaches the expansion valve 4 in which it is subjected to pressure reduction. Then, it is delivered to the evaporator 5 in which it is evaporated by extracting heat from the surroundings. After completion of evaporation refrigerant comes back to the compressor 1 and thereby a single cycle of refrigeration is finished.

As will be readily understood from the above description, in addition to the functional effects obtained from the refrigerating apparatus in accordance with the first embodiment in which a large part of refrigerant flows through the second air cooling type condenser 14 in the form of liquidized refrigerant during operation of the apparatus with the aid of water cooling the refrigerating apparatus in accordance with the second embodiment has such a functional effect that refrigerant liquid is discharged from the gas-liquid separator 20 without any entrance into the second air cooling type condenser 14. As a result it is assured that a volume of refrigerant liquid to be held in the second air cooling type condenser 14 can be substantially reduced and thereby a volume of refrigerant required for the refrigerating apparatus can be reduced correspondingly.

It should be noted that the lowermost end position of the gas-liquid separator 20 may be determined in such a manner that differential pressure is developed at the junction 23 corresponding to the maximum pressure loss of refrigerant in the second air cooling type condenser 14.

While the present invention has been described above with respect to two preferred embodiments, it should be of course be understood that it should not be limited only to them but many changes or modifications may be made without any departure from the spirit and scope of the invention.

Since the refrigerating apparatus of the invention as constructed in the above-described manner consists in that an upstream air cooling type condenser and a downstream air cooling type condenser are separately arranged in a refrigerating system including a compressor, air cooling type condensers, an expansion valve and an evaporator and a water cooling type condenser is disposed between both the upstream and downstream air cooling type condensers, it is assured that a space required for mounting the refrigerating apparatus is substantially reduced, resulting in excellent industrial advantages being obtained therefrom.

I claim:

1. A refrigerating apparatus comprising, a compressor, a condenser having an inlet and an outlet, an expansion valve, and an evaporator all connected in series, an upstream air cooled condenser adjacent said condenser having an inlet and an outlet, said upstream air cooled condenser inlet being connected to said compressor, a downstream air cooled condenser adjacent said expansion valve having an inlet and an outlet with said outlet of said downstream air cooled condenser being connected to said inlet of said expansion valve, a water cooled condenser having an inlet and an outlet and being connected between both of said upstream and downstream air cooled condensers, said inlet of said water cooled condenser being connected to said outlet of said upstream air cooled condenser and said outlet of said water cooled condenser being connected to said inlet of said downstream air cooled condenser.

2. A refrigerating apparatus as defined in claim 1, characterized in that a gas-liquid separator is disposed between both the upstream and downstream air cooling type condensers.

3. A refrigerating apparatus as defined in claim 2, characterized in that an upper communicating pipe extending from said gas-liquid separator is connected to the downstream air cooling type condenser while a lower communicating pipe extending from the gas-liquid separator is connected to the downstream side of the downstream air cooling type condenser.

4. A refrigerating apparatus as defined in claim 3, characterized in that the lowermost end position of the gas-liquid separator is determined to such a lowered level that differential pressure is developed at a junction located on the lower communicating pipe, corresponding to the maximum pressure loss of refrigerant in the downstream air cooling type condenser.

5. A refrigerating apparatus for utilizing a selected volume of liquid refrigerant, consisting essentially of:

an evaporator having an input for receiving liquid refrigerant and an output for discharging gaseous refrigerant;

a compressor connected to said evaporator output for compressing the gaseous refrigerant;

a first air cooling type condenser for receiving compressed gaseous refrigerant from said compressor, said first air-cooling type condenser including a first air blower activatable for condensing refrigerant in said first air cooling-type condenser;

a water-cooling type condenser connected in series with said first air cooling type condenser for receiving refrigerant and including water circulating means activatable for circulating water through said water-cooling type condenser for condensing refrigerant therein;

a second air-cooling type condenser connected in series with said water-cooling type condenser and including a second blower which is activatable for condensing refrigerant in said second air-cooling type condenser; and an expansion valve connected in series between said second air-cooling type condenser and said evaporator input for reducing pressure on liquid refrigerant supplied to said evaporator;

said first and second air-cooling type condensers and said water-cooling type condenser having a combined volume corresponding to the selected volume of liquid refrigerant so that no additional storage space for liquid refrigerant is necessary.

6. A refrigerating apparatus for utilizing a selected volume of liquid refrigerant, consisting essentially of:

an evaporator having an input for receiving liquid refrigerant and an output for discharging gaseous refrigerant;

a compressor connected to said evaporator output for compressing the gaseous refrigerant;

a first air cooling type condenser for receiving compressed gaseous refrigerant from said compressor, said first air-cooling type condenser including a first air blower activatable for condensing refrigerant in said first air-cooling type condenser;

a water-cooling type condenser connected in series with said first air-cooling type condenser for receiving refrigerant and including water-circulating means activatable for circulating water through said water-cooling type condenser for condensing refrigerant therein;

a second air-cooling type condenser connected in series with said water-cooling type condenser and including a second blower which is activatable for condensing refrigerant in said second air-cooling type condenser;

an expansion valve connected in series between said second air-cooling type condenser and said evaporator input for reducing pressure on liquid refrigerant supplied to said evaporator;

said first and second air-cooling type condensers and said water-cooling type condenser having a combined volume corresponding to the selected volume of liquid refrigerant so that no additional storage space for liquid refrigerant is necessary;

said water-cooling type condenser being connected in series to said second air-cooling type condenser by a liquid/water separator having an input for receiving refrigerant from said water-cooling type condenser, a first upper output for discharging gaseous refrigerant and a second lower output for discharging liquid refrigerant, said second air-cooling type condenser having an upper input connected to said first upper output of said separator and a lower output, a junction connected to said lower output of second air-cooling type condenser and to said second lower output of said separator for combining liquid refrigerant from a lower end of said separator with liquid refrigerant from said lower output of said second air-cooling type condenser, said junction connected to an input of said expansion valve.

7. A refrigerating apparatus according to claim 6, wherein said separator input is located above said junction so that a net pressure is exerted at said junction with a level of liquid in said separator above said junction.

* * * * *